US006294077B1

(12) United States Patent
Dougherty et al.

(10) Patent No.: US 6,294,077 B1
(45) Date of Patent: Sep. 25, 2001

(54) PRODUCTION OF HIGH VISCOSITY LUBRICATING OIL STOCK WITH IMPROVED ZSM-5 CATALYST

(75) Inventors: Richard C. Dougherty, Moorestown; Dominick N. Mazzone, Wenonah, both of NJ (US); Richard F. Socha, Newtown, PA (US); Hye Kyung Cho Timken, Woodbury, NJ (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/496,693

(22) Filed: Feb. 2, 2000

(51) Int. Cl.[7] ..... C10G 73/02; C10G 47/02
(52) U.S. Cl. ..... 208/27; 208/89; 208/111.35
(58) Field of Search ..... 208/27, 89, 111.35

(56) References Cited

U.S. PATENT DOCUMENTS

| | | | | |
|---|---|---|---|---|
| Re. 28,341 | | 2/1975 | Wadlinger et al. . | |
| 3,308,069 | | 3/1967 | Wadlinger . | |
| 3,700,585 | | 10/1972 | Chen et al. . | |
| 3,894,938 | | 7/1975 | Gorring et al. . | |
| 3,956,102 | | 5/1976 | Chen et al . | |
| 3,968,024 | | 7/1976 | Gorring et al. . | |
| 4,097,365 | | 6/1978 | Ward . | |
| 4,222,388 | | 9/1980 | Pelrine et al. . | |
| 4,247,388 | | 1/1981 | Banta et al. . | |
| 4,283,271 | | 8/1981 | Garwood et al. . | |
| 4,284,529 | * | 8/1981 | Shihabi | 502/71 |
| 4,402,866 | * | 9/1983 | Shihabi | 502/77 |
| 4,419,220 | | 12/1983 | LaPierre et al. . | |
| 4,439,310 | * | 3/1984 | Audeh et al. | 208/111.15 |
| 4,448,673 | * | 5/1984 | Shihabi | 208/111.15 |
| 4,518,485 | | 5/1985 | LaPierre et al. . | |
| 4,574,043 | | 3/1986 | Chester et al. . | |
| 4,710,485 | | 12/1987 | Miller . | |
| 4,719,004 | * | 1/1988 | Chu et al. | 208/111.1 |
| 4,724,270 | | 2/1988 | Chang et al. . | |
| 4,764,266 | | 8/1988 | Chen et al. . | |
| 4,783,571 | | 11/1988 | Chang et al. . | |
| 4,790,928 | * | 12/1988 | Chang et al. | 208/111.35 |
| 4,808,296 | * | 2/1989 | Chen et al. | 208/111.35 |
| 4,835,336 | | 5/1989 | McCullen . | |
| 4,851,109 | | 7/1989 | Chen . | |
| 4,859,311 | | 8/1989 | Miller . | |
| 4,859,312 | | 8/1989 | Miller . | |
| 4,861,932 | | 8/1989 | Chen et al. . | |
| 4,877,581 | * | 10/1989 | Chen et al. | 585/751 |
| 5,015,361 | * | 5/1991 | Anthes et al. | 208/111.25 |
| 5,075,269 | | 12/1991 | Degnan et al. . | |
| 5,135,638 | | 8/1992 | Miller . | |
| 5,246,566 | | 9/1993 | Miller . | |
| 5,282,958 | * | 2/1994 | Santilli et al. | 208/111.15 |
| 5,565,086 | | 10/1996 | Cody et al . | |
| 5,833,837 | | 11/1998 | Miller . | |
| 5,951,848 | | 9/1999 | Baker, Jr. et al. . | |
| 5,965,475 | | 10/1999 | Wittenbrink et al . | |

FOREIGN PATENT DOCUMENTS

| | | | |
|---|---|---|---|
| 92/01657 | * | 2/1992 | (WO) . |

* cited by examiner

*Primary Examiner*—Walter D. Griffin
(74) *Attorney, Agent, or Firm*—Malcolm D. Keen; James H. Takemoto

(57) ABSTRACT

The present invention is a process for producing a high viscosity index and low pour point lubricating oil base stock which comprises catalytically converting a hydrotreated hydrocarbon lube oil feedstock containing waxy paraffins in the presence of hydrogen and in the presence of a low acidity ZSM-5 catalyst having a highly dispersed noble metal component. The ZSM-5 catalyst is subjected to controlled acidity reduction to an alpha value below 15 prior to incorporation of the noble metal component.

9 Claims, 5 Drawing Sheets nC16 Isomerization Activity and Selectivity Comparison

Isomerization of Hydrocracked Slack Wax With 1% Pt/Low-Acidity ZSM-5

Comparison of Pt/ZSM-5 and Solvent Dewaxing for a Hydrocracked Heavy Neutral Feedstock Dewaxing Selectivity of Pt/Low-Acidity ZSM-5
for a Light Neutral Furfural Raffinate

PRODUCTION OF HIGH VISCOSITY LUBRICATING OIL STOCK WITH IMPROVED ZSM-5 CATALYST

BACKGROUND OF THE INVENTION

The present invention relates to converting hydrotreated hydrocarbon lube oil feedstocks. In particular, it relates to catalytic conversion of hydrotreated hydrocarbon lube oil feedstocks which contain waxy paraffins to produce lube oil base stocks having high viscosity index and low pour point.

Mineral oil based lubricants are conventionally produced by a separative sequence carried out in the petroleum refinery which comprises fractionation of a paraffinic crude oil under atmospheric pressure followed by fractionation under vacuum to produce distillate fractions (neutral oils) and a residual fraction which, after deasphalting and severe solvent treatment may also be used as a lubricant base stock. This refined residual fraction is usually referred to as bright stock. Neutral oils, after solvent extraction to remove low viscosity index (VI) components, are conventionally subjected to dewaxing, either by solvent or catalytic dewaxing processes, to achieve the desired pour point. The dewaxed lube stock may be hydrofinished to improve stability and remove color bodies. Viscosity Index (VI) is a reflection of the amount of viscosity decrease a lubricant undergoes with an increase in temperature. The products of solvent dewaxing are dewaxed lube oil and slack wax.

Catalytic dewaxing of lube stocks is accomplished by converting waxy molecules to light products by cracking, or by isomerizing waxy molecules to form species which remain in the dewaxed lube. Conventional dewaxing catalysts preserve high yield primarily by having pore structures which inhibit cracking of cyclic and highly branched species, those generally associated with dewaxed lube, while permitting easier access to catalytically active sites to near-linear molecules, of which wax is generally composed. Catalysts which significantly reduce the accessibility of species on the basis of molecular size are termed shape selective. Increasing the shape selectivity of a dewaxing catalyst will frequently increase the yield of dewaxed oil.

The shape selectivity of a dewaxing catalyst is limited practically by its ability to convert waxy molecules which have a slightly branched structure. These types of species are more commonly associated with heavier lube stocks, such as bright stocks. Highly shape selective dewaxing catalysts may be unable to convert heavy, branched wax species leading to a hazy lube appearance at ambient temperature and high cloud point relative to pour point.

Conventional lube refining techniques rely upon the proper selection and use of crude stocks, usually of a paraffinic character, which produce lube fractions with desired qualities in adequate amounts. The range of permissible crude sources may, however, be extended by the lube hydrocracking process which is capable of utilizing crude stocks of marginal or poor quality, usually with a higher aromatic content than the better paraffinic crudes. The lube hydrocracking process, which is well established in the petroleum refining industry, generally comprises an initial hydrocracking step carried out under high pressure, at high temperature, and in the presence of a bifunctional catalyst which effects partial saturation and ring opening of the aromatic components which are present in the feed. The hydrocracked product is then subjected to dewaxing in order to reach the target pour point since the hydrocracked product usually contains species with relatively high pour points. Frequently the liquid product from the dewaxing step is subjected to a low temperature, high pressure hydrotreating step to reduce the aromatic content of the lube to the desired level.

Current trends in the design of automotive engines are associated with higher operating temperatures as the efficiency of the engines increases. These higher operating temperatures require successively higher quality lubricants. One of the requirements is for higher viscosity indices (VI) in order to reduce the effects of the higher operating temperatures on the viscosity of the engine lubricants. High VI values have conventionally been attained by the use of VI improvers, e.g. polyacrylates and polystyrenes. VI improvers tend to undergo degradation due to high temperatures and high shear rates encountered in the engine. The more stressing conditions encountered in high efficiency engines result in even faster degradation of oils which employ significant amounts of VI improvers. Thus, there is a continuing need for automotive lubricants which are based on fluids of high Viscosity Index and which are resistant to the high temperature, high shear rate conditions encountered in modern engines.

Synthetic lubricants produced by the polymerization of olefins in the presence of certain catalysts have been shown to possess excellent VI values, but they are relatively expensive to produce. There is therefore a need for the production of high VI lubricants from mineral oil stocks which may be produced by techniques comparable to those presently employed in petroleum refineries.

U.S. Pat. No. 4,975,177 discloses a two-stage dewaxing process for producing lube stocks of high VI from waxy feedstocks. In the first stage of that process, the waxy feed is catalytically dewaxed by isomerization over zeolite beta. The product of the isomerization step still contains waxy species and requires further dewaxing to meet target pour point. The second-stage dewaxing employs either solvent dewaxing, in which case the rejected wax may be recycled to the isomerization stage to maximize yield, or catalytic dewaxing. Catalysts which may be used in the second stage are ZSM-5, ZSM-22, ZSM-23, and ZSM-35. To preserve yield and VI, the second stage dewaxing catalyst should have selectivity similar to solvent dewaxing. U.S. Pat. No. 4,919,788 also teaches a two-stage dewaxing process in which a waxy feed is partially dewaxed by isomerization over a siliceous Y or beta catalyst with the product subsequently dewaxed to desired pour point using either solvent dewaxing or catalytic dewaxing. Dewaxing catalysts with high shape selectivity, such as ZSM-22 and ZSM-23, are disclosed as preferred catalysts.

Dewaxing processes employing highly shape selective sieves as catalysts possess greater selectivity than conventional catalytic dewaxing processes. To improve catalytic activity and to mitigate catalyst aging, these high selectivity catalysts often contain a hydrogenation/dehydrogenation component, frequently a noble metal. Such selectivity benefit is derived from the isomerization capability of the catalyst from its metallic substituent and its highly shape-selective pore structure. However, ZSM-23, and some other highly selective catalysts used for lube dewaxing, have a unidimensional pore structure. This type of pore structure is particularly susceptible to blockage by coke formation inside the pores and by adsorption of polar species at the pore mouth. Therefore, such catalysts have been used commercially only for dewaxing "clean" feedstocks such as hydrocrackates and severely hydrotreated solvent extracted raffinates. In the development of shape selective dewaxing processes, key issues to be addressed are retardation of aging, preservation of high selectivity over the duration of the catalyst cycle, and maintenance of robustness for dewaxing a variety of feedstocks.

U.S. Pat. No. 4,222,543 (Pelrine) and U.S. Pat. No. 4,814,543 (Chen et al.) were the earliest patents to disclose and claim the use of constrained intermediate pore molecular sieves for lube dewaxing. U.S. Pat. No. 4,283,271 (Garwood et al.) and U.S. Pat. No. 4,283,272 (Garwood et al.) later claimed the use of these catalysts for dewaxing hydrocrackates in energy efficient configurations. Also directed to dewaxing with constrained intermediate pore molecular sieves are U.S. Pat. No. 5,135,638 (Miller), U.S. Pat. No. 5,246,566 (Miller) and U.S. Pat. No. 5,282,958 (Santilli). None of these patents was, however, directed to catalyst durability. Pelrine's examples were directed to start-of-cycle performance with furfural raffinates as feeds. The catalysts used in Pelrine's examples typically age rapidly when exposed to these feeds.

Previous inventions have addressed the problem of catalyst aging and extension of cycle length in dewaxing processes involving intermediate pore zeolites, such as ZSM-5. For example, U.S. Pat. No. 5,456,820 (Forbus et al.) discloses a process in which a lube boiling range feedstock is catalytically dewaxed in the presence of hydrogen over a catalyst comprising an intermediate pore zeolite in the decationized form. Catalyst cycle length was found to be improved by optimizing the sequencing of various solvent extracted feedstocks.

U.S. Pat. No. 4,892,646 (Venkat et al.) discloses a process for increasing the original cycle length, subsequent cycle lengths and the useful life of a dewaxing catalyst comprising an intermediate pore zeolite (i.e., ZSM-5) and preferably, a noble metal such as Pt. The catalyst is pretreated with a low molecular weight aromatic hydrocarbon at a temperature greater than 800° F., for a time sufficient to deposit between 2 and 30% of coke, by weight, on the catalyst. The pretreatment may be conducted in the presence of hydrogen gas.

Chen, et al (U.S. Pat. No. 4,749,467), discloses a method for extending dewaxing catalyst cycle length by employing the combination of low space velocity and a high acidity intermediate pore zeolite. The high acid activity and low space velocity reduce the start-of-cycle temperature. Because catalyst deactivation reactions are more temperature sensitive than are dewaxing reactions, low operating temperatures reduce the catalyst aging rate. The same principle has been found to apply to unidimensional constrained intermediate pore molecular sieves.

Dewaxing catalysts comprising intermediate pore molecular sieves containing noble metals have been found to have relatively high aging rates when dewaxing heavy hydrocrackate feeds at a space velocity of 1 LHSV or greater. The catalyst eventually lines out at high temperature, resulting in non-selective cracking and significant yield loss. The aging rate and yield loss with time can be reduced somewhat by operation at a relatively low space velocity. Additionally, noble metal-containing constrained intermediate pore catalysts age very rapidly when exposed to feedstocks having even modest levels of nitrogen and sulfur, such as mildly hydrotreated solvent refined feeds or hydrocrackates produced at low hydrocracker severity.

Thus, there is a need for a process which employs a catalyst capable of selectively converting a wide range of waxy lube oil range hydrocarbon streams to provide a lube oil base stock having a high viscosity index and a low pour point and which does not have the above mentioned disadvantages.

SUMMARY OF INVENTION

According to the present invention, it has now been found that a lubricating oil base stock having a low pour point and a high viscosity index can be produced by using a catalyst comprising a zeolite ZSM-5, which has been subjected to controlled acidity reduction, and a finely dispersed noble metal component. The present process provides lube oil yields and viscosity indices comparable to those obtained by solvent dewaxing and by dewaxing using highly shape selective, unidimensional pore zeolites such as ZSM-23. Moreover, the more open pore structure of the ZSM-5 permits dewaxing of a wider range of feed stocks than the highly shape selective zeolites (i.e. ZSM-23) and is less susceptible to deactivation pore blockage.

More specifically, the present invention is a process for increasing the viscosity index of a dewaxed lube oil basestock resulting from a hydrotreated hydrocarbon lube oil feedstock containing waxy paraffins which comprises contacting said hydrotreated hydrocarbon lube oil feedstock with a catalyst comprising ZSM-5, which has been subjected to controlled acidity reduction, and which further comprises a finely dispersed noble metal component, in the presence of hydrogen, under conversion conditions.

DETAILED DESCRIPTION OF INVENTION

Figure 1:
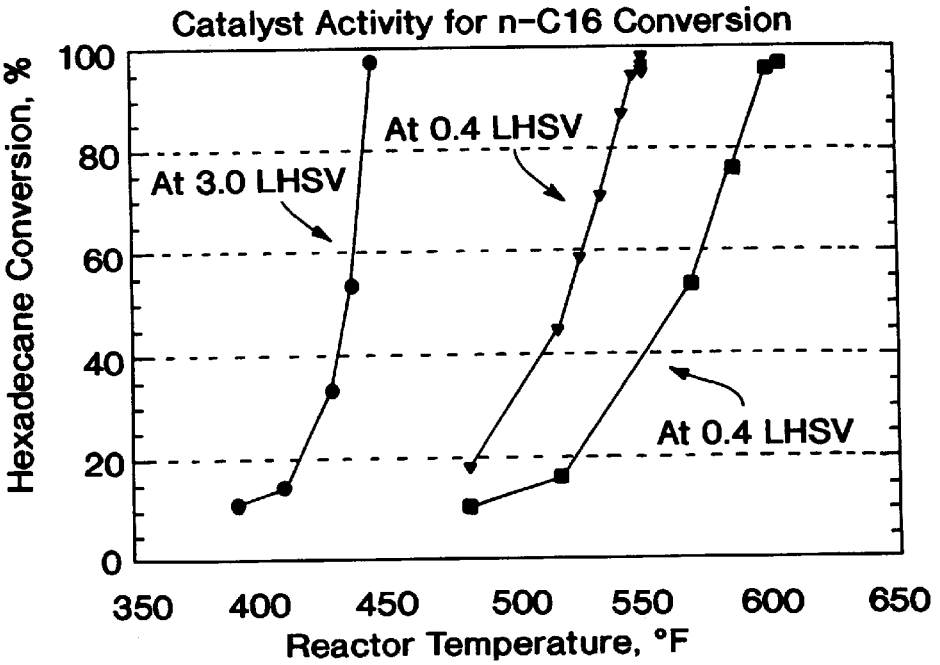
FIG. 1 shows the relative catalyst isomerization activity and selectivity for converting normal hexadecane over a 1.1 wt % Pt/ZSM-5 (alpha=8), a 0.47 wt % Pt/ZSM-5 (alpha=280) and a 0.44 wt % Pt/ZSM-5 (alpha=1), respectively.
Figure 1:
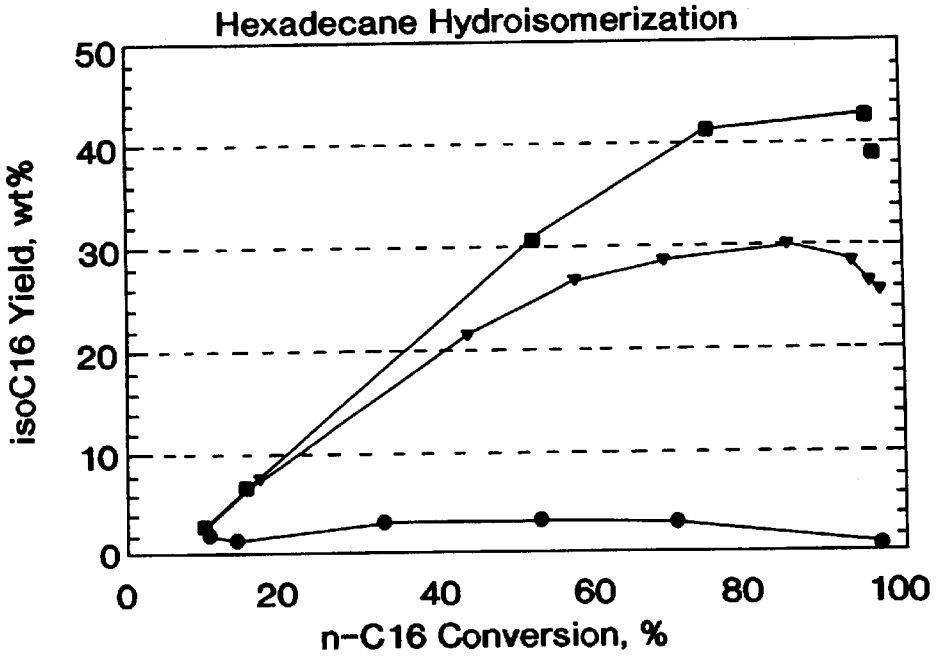

In the present process, lube oil feedstocks with a relatively high wax content are converted to high VI lubricants in a conversion process using a low acidity zeolite ZSM-5 catalyst with an initial silica/alumina ratio between about 12 and 2000, preferably between about 40 and 200, which has been subjected to a controlled acidity reduction and contains a highly dispersed noble metal component. The products are characterized by good viscometric properties including high Viscosity Index, typically at least 90 and usually in the range of 100 to 150, and low pour points, typically below at least 40° F. and usually in the range of −60° F. to 20° F.

Feedstocks

The present process is capable of operating with a wide range of feeds of mineral oil origin to produce a range of lubricant products with good performance characteristics. Such characteristics include low pour point, low cloud point, and high Viscosity Index. The quality of the product and the yield in which it is obtained is dependent upon the quality of the feed and its amenability to processing by the catalysts of the instant invention. Products of the highest VI are obtained by using preferred wax feeds such as slack wax, deoiled wax, vacuum distillates or raffinates derived from waxy crudes. Waxes produced by Fischer-Tropsch processing of synthesis gas may also be used as feedstocks. Products with lower VI values may also be obtained from other feeds which contain a lower initial quantity of waxy components. The feeds which may be used should have an initial boiling point which is no lower than the initial boiling point of the desired lubricant. A typical initial boiling point of the feed exceeds 650° F. (343° C.). Feeds of this type which may be used include vacuum gas oils as well as other high boiling fractions such as distillates from the vacuum distillation of atmospheric resids, raffinates from the solvent extraction of such distillate fractions, hydrocracked vacuum distillates and waxes from the solvent dewaxing of raffinates and hydrocrackates. In addition, deasphalted oils from the bottom of a vacuum distillation unit may also be used as feedstocks to this process. Mixtures or blends of the above mentioned feedstocks can also be used.

The crude lube oil feedstocks discussed above are first hydrotreated to remove low VI components such as aromatics and polycyclic naphthenes. Removal of these materials will result in a feed for the conversion process which contains higher quantities of waxy paraffins which are then converted to high VI, low pour point iso-paraffins. Hydrotreatment is an effective pretreatment step, particularly at high hydrogen pressures which are effective for aromatics saturation, e.g. 800 psig (about 5,600 kPa) or higher. Mild hydrocracking may also be employed as pretreatment and is preferred in the instant invention. Pressures over 1000 psig are preferred for hydrocracking treatment. Hydrocracking removes or reduces nitrogen containing and sulfur-containing species and reduces aromatics content. Hydrocracking generally also slightly alters the boiling range of the feed, causing it to boil in a lower range. Commercially available catalysts such as fluoride nickel-tungsten on fluorided alumina (NiW/F—$Al_2O_3$) may be employed for the hydrocracking pretreatment.

Hydrotreating Process

The crude lube oil feedstocks will be subjected to some degree of hydrotreatment, such as hydrocracking in the presence of an amorphous bifunctional catalyst to promote the saturation and ring opening of the low quality aromatic components in the feed to produce hydrocracked products which are relatively more paraffinic. Hydrocracking is carried out under high pressure to favor aromatics saturation but the boiling range conversion is maintained at a relatively low level in order to minimize cracking of the saturated components of the feed and of the products obtained from the saturation and ring opening of the aromatic materials. Consistent with these process objectives, the hydrogen pressure in the hydrocracking stage is at least 800 psig (about 5500 kPa) and usually is in the range of 1,000 to 3,000 psig (about 6900 to 20700 kPa). Normally, hydrogen partial pressures of at least 1500 psig (about 10500 kPa) are best in order to obtain a high level of aromatic saturation. Hydrogen circulation rates of at least about 1000 scf/bbl (about 180 $n.l.l^{-1}$), preferably in the range of 2,000 to 8,000 scf/bbl (about 900 to 1800 $n.l.l^{-1}$) are suitable.

In the hydrocracking process, the conversion of the feed to products boiling below the lube boiling range, typically to 650° F.—(about 345° C.—) products is limited to no more than 50 weight percent of the feed and will usually be not more than 30 weight percent of the feed in order to maintain the desired high single pass yields which are characteristic of the process. The actual conversion is dependent on the quality of the feed with slack wax feeds requiring a lower conversion than petrolatum where it is necessary to remove more low quality polycyclic components. For slack wax feeds derived from the dewaxing of neutral stocks, the conversion to 650° F.—products will, for all practical purposes not be greater than 10 to 20 weight percent, with 5–15 weight percent being typical for most slack waxes. Higher conversions may be encountered with petrolatum feeds because they typically contain more low quality components. With petrolatum feeds, the hydrocracking conversion will typically be in the range of 15 to 25 weight percent to produce high VI products. The conversion may be maintained at the desired value by control of the temperature in the hydrocracking stage which will normally be in the range 600° to 800° F. (about 315° to 430° C.) and more usually in the range of about 650° to 750° F. (about 345° to 400° C.). Space velocity variations may also be used to control severity although this will be less common in practice in view of mechanical constraints on the system. Generally, the space velocity (LHSV) will be in the range of 0.25 to 2 $hr^{-1}$ and usually in the range of 0.5 to 1.5 $hr^{-1}$.

A characteristic feature of the hydrocracking operation is the use of a bifunctional catalyst. In general terms, these catalysts include a metal component for promoting the desired aromatics saturation reactions and usually a combination of base metals is used, with one metal from Group VIII in combination with a metal of Group VIB. Thus, the base metal such as nickel or cobalt is used in combination with molybdenum or tungsten. The preferred combination is nickel/tungsten since it has been found to be highly effective for promoting the desired aromatics hydrocracking reaction. Noble metals such as platinum or palladium may be used since they have good hydrogenation activity in the absence of sulfur but they will normally not be preferred. The amounts of the metals present on the catalyst are conventional for lube hydrocracking catalysts of this type and generally will range from 1 to 10 weight percent of the Group VIII metal and 10 to 30 weight percent of the Group VIB metal, based on the total weight of the catalyst. If a noble metal component such as platinum or palladium is used instead of a base metal such as nickel or cobalt, relatively lower amounts are in order in view of the higher hydrogenation activities of these noble metals, typically from about 0.5 to 5 weight percent being sufficient. The metals may be incorporated by any suitable method including impregnation onto the porous support after it is formed into particles of the desired size or by addition to a gel of the support materials prior to calcination. Addition to the gel is a preferred technique when relatively high amounts of the metal components are to be added, e.g. above 10 weight percent of the Group VIII metal and above 20 weight percent of the Group VIB metal. These techniques are conventional in character and are employed for the production of lube hydrocracking catalysts.

The metal component of the catalyst is generally supported on a porous, amorphous metal oxide support and alumina is preferred for this purpose although silica-alumina may also be employed. Other metal oxide components may also be present in the support although their presence is less desirable. The support may be fluorided. Consistent with the requirements of a lube hydrocracking catalyst, the support should have a pore size and distribution which is adequate to permit the relatively bulky components of the high boiling feeds to enter the interior pore structure of the catalyst where the desired hydrocracking reactions occur. To this extent, the catalyst will normally have a minimum pore size of about 50 Å, i.e with no less than about 5 percent of the pores having a pore size less than 50 Å, with the majority of the pores having a pore size in the range of 50–400 Å(no more than 5 percent having a pore size above 400 Å), preferably with no more than about 30 percent having pore sizes in the range of 200–400 Å. Preferred hydrocracking catalysts for the first stage have at least 60 percent of the pores in the 50–200 Å range.

If necessary to obtain the desired conversion, the catalyst may be promoted with fluorine, either by incorporating fluorine into the catalyst during its preparation or by operating the hydrocracking in the presence of a fluorine compound which is added to the feed. Fluorine containing compounds may be incorporated into the catalyst by impregnation during its preparation with a suitable fluorine compound such as ammonium fluoride ($NH_4F$) or ammonium bifluoride ($NH_4F.HF$) of which the latter is preferred. The amount of fluorine used in catalysts which contain this element is preferably from about 1 to 10 weight percent, based on the total weight of the catalyst, usually from about 2 to 6 weight percent. The fluorine may be incorporated by adding the fluorine compound to a gel of the metal oxide support during the preparation of the catalyst or by impregnation after the particles of the catalyst have been formed by drying or calcining the gel. If the catalyst contains a relatively high amount of fluorine as well as high amounts of the metals, as noted above, it is preferred to incorporate the metals and the fluorine compound into the metal oxide gel prior to drying and calcining the gel to form the finished catalyst particles.

The catalyst activity may also be maintained at the desired level by in situ fluoriding in which a fluorine compound is added to the stream which passes over the catalyst in this stage of the operation. The fluorine compound may be added continuously or intermittently to the feed or, alternatively, an initial activation step may be carried out in which the fluorine compound is passed over the catalyst in the absence of the feed, e.g. in a stream of hydrogen in order to increase the fluorine content of the catalyst prior to initiation of the actual hydrocracking. In situ fluoriding of the catalyst in this way is preferably carried out to induce a fluorine content of about 1 to 10 percent fluorine prior to operation, after which the fluorine can be reduced to maintenance levels sufficient to maintain the desired activity. Suitable compounds for in situ fluoriding are orthofluorotoluene and difluoroethane.

The metals present on the catalyst are preferably used in their sulfide form and to this purpose pre-sulfiding of the catalyst should be carried out prior to initiation of the hydrocracking. Sulfiding is an established technique and it is typically carried out by contacting the catalyst with a sulfur-containing gas, usually in the presence of hydrogen. The mixture of hydrogen and hydrogen sulfide, carbon disulfide or a mercaptan such as butol mercaptan is conventional for this purpose. Presulfiding may also be carried out by contacting the catalyst with hydrogen and a sulfur-containing hydrocarbon oil such as a sour kerosene or gas oil.

Conversion Process

The paraffinic components present in the original wax feed generally possess good VI characteristics but have relatively high pour points as a result of their paraffinic nature. The objective of this invention is, therefore, to effect a selective conversion of waxy species while minimizing conversion of more branched species characteristic of lube components. The conversion of wax occurs preferentially by isomerization to form more branched species which have lower pour points and cloud points. Some degree of cracking accompanies isomerization and cracking is required to produce very low pour point lube oils.

Conversion Catalyst

The catalyst used in this invention is one which has a high selectivity for the isomerization of waxy, linear or near linear paraffins to less waxy, isoparaffinic products. The catalyst is bifunctional in character, comprising a highly dispersed metal component on an intermediate pore size zeolite ZSM-5 support of low acidity. The ZSM-5 zeolite has an initial silica-to-alumina ratio from about 12 to about 2000, preferably about 40 to 200, and a crystal size of less than about 0.5 micron, preferably less than about 0.1 micron. The acidity is maintained at a low level in order to reduce conversion to products boiling outside the lube boiling range. In general terms, the catalyst should have an alpha value below 15 prior to metals addition, preferably below 10, and more preferably below 5.

The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 sec −1). The alpha test is described in U.S. Pat. No. 3,354,078 and in J. Catalysis, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in J. Catalysis, 61, 395 (1980).

The ZSM-5 support is subjected to controlled acidity reduction to achieve the required alpha value prior to metals addition. This controlled acidity reduction can be achieved via various methods such as (i) steaming, (ii) chemical dealumination and (iii) direct synthesis of highly siliceous ZSM-5 with no added aluminum in the synthesis gel. Chemical dealumination typically uses an acid solution, silicon halide or chelating agents to remove zeolitic aluminum sites and lower the acidity. Preferably the acidity is reduced by severe steaming.

Although other low-acidity ZSM-5 catalysts can produce products having relatively high lube oil yield, high VI and low pour point in accordance with the invention, the optimum performance of the catalyst is achieved by reducing the alpha value through severe steaming of the ZSM-5 zeolite. It is believed that severe steaming achieves the necessary chemical balance between the acid function and the metal function, while imparting enhanced resistance to deactivation for a wide range of different lube oil feedstocks. The low alpha value can be achieved by steaming the ZSM-5 zeolite, having a typical silica-to-alumina ratio of about 55, for at least about 12 hours, preferable in the range of about 12 to 96 hours, at a temperature of from about 550° to about 900° C., and at a pressure from about atmospheric up to about 100 psig. The steaming time, pressure and temperature can be adjusted collectively to generate a similar effect in activity reduction at different levels. Any combination of time, pressure and temperature can be utilized, so long as the appropriate ZSM-5 zeolite alpha value is achieved, which is below at least 15. The alpha value is preferably below about 10, and most preferably below about 5.

The zeolite ZSM-5 support can be combined with a matrix material to form the finished catalyst and for this purpose conventional very low-acidity matrix materials such as alumina, silica-alumina and silica are suitable although aluminas such as alpha boehmite (alpha alumina monohydrate) may also be used, provided that they do not confer any substantial degree of acidic activity on the matrixed catalyst. The zeolite is usually composited with the matrix in amounts from 80:20 to 20:80 by weight, typically from 80:20 to 50:50 zeolite:matrix. Compositing may be done by conventional means including simple physical mixing, ball-milling or wet mulling the materials together followed by dry pressing or extrusion into the desired finished catalyst particles. A method for extruding the zeolite with silica as a binder is disclosed in U.S. Pat. No. 4,582,815. The finished catalyst particles can be precalcined to stabilize the support structure at temperatures of about 1000° F. and for about 0.5 to about 10 hours or longer as required. If a matrix (or binder) material is used, the catalyst is steamed after it has been formulated with the binder in order to achieve the desired low acidity. The preferred binder for the steamed catalyst is alumina.

The catalyst also includes a metal component in order to promote the desired conversion reactions which, proceeding through unsaturated transitional species, require mediation by a hydrogenation-dehydrogenation component. In order to maximize the isomerization activity of the catalyst, metals having a strong hydrogenation function are preferred and for this reason, platinum and the other noble metals such as rhenium, gold, and palladium are given a preference. The most preferred noble metals are platinum, palladium or mixtures of platinum and palladium. The amount of the noble metal (e.g. platinum) component is typically in the range 0.1 to 5 weight percent of the total catalyst, usually from 0.1 to 2 weight percent. The platinum must be incorporated into the catalyst so that it is highly dispersed, such as by ion exchange with complex platinum cations such as platinum tetraammnine, for example, with platinum tetraammine salts such as platinum tetraammine chloride. The noble metal dispersion, measured by chemisorption as a ratio of H to noble metal (H/noble metal), is at least about 0.6, preferably at least about 0.8, and the ratio of O to noble metal (O/noble metal), is at least about 0.4, preferably at least about 0.6. The catalyst may be subjected to a final calcination under conventional conditions in order to convert the noble metal to its reduced form and to confer the required mechanical strength on the catalyst. Prior to use the catalyst may be subjected to presulfiding as described above for the hydrocracking pretreatment catalyst.

Conversion Conditions

The conditions for the conversion process are adjusted to achieve the objective of isomerizing the waxy, linear and near-linear paraffinic components in the waxy feed to less waxy but high VI isoparaffinic materials of relatively lower pour point. This end is achieved while minimizing conversion to non-lube oil boiling range products (usually 650° F.—(345° C.—) materials). Since the catalyst used for the conversion has a low acidity and a highly dispersed metal component, conversion to lower boiling products is usually at a relatively low level and by appropriate selection of severity, the operation of the process may be optimized for isomerization over cracking. At conventional space velocities of about 1, using a Pt/ZSM-5 catalyst with an alpha value below 15, preferably below 10, and more preferably below 5, temperatures for the conversion process will typically be in the range of about 600° F. to about 750° F. (about 315° C. to 400° C. ) with conversion to 650° F.—typically being from about 5 to 50 weight percent, more usually 10 to 25 weight percent, depending upon the particular waxy feed. Approximately 40 to 90 percent of the wax in the feedstock is converted in accordance with the invention. However, temperatures may be used outside this range, for example, as low as about 392° F. (200° C.) and up to about 800° F. (about 425° C.) although the higher temperatures will usually not be preferred since they will be associated with a lower isomerization selectivity and the production of less stable lube oil products as a result of the hydrogenation reactions being thermodynamically less favored at progressively higher operating temperatures. Space velocities (LHSV) will typically be in the range of 0.2 to 2.0 $hr^{-1}$. The pour point of the effluent from the conversion process is in the range from −60 to 40° F., preferably in the range from −20° to +20° F.

The conversion process is operated at hydrogen partial pressures (reactor inlet) of at least about 300 psig (about 2069 KPa), usually 300 to 3500 psig (2069 to 24,249 kPa) and in most cases 500 to 2500 psig (3448 to 17242 kPa). Hydrogen circulation rates are usually in the range of about 500 to 5000 scf/bbl (about 90 to 900 $n.l.l^{-1}$). Since some saturation of aromatic components present in the original feedstock takes place in the presence of the noble metal hydrogenation component on the catalyst, some hydrogen is consumed in the conversion process even though the desired isomerization reactions are in hydrogen balance; for this reason, hydrogen circulation rates may need to be adjusted in accordance with the aromatic content of the feed and also with the temperature used in the conversion process since higher temperatures will be associated with a higher level of cracking and, consequently, with a higher level of olefin production, some of which will be in the lube oil boiling range so that product stability will need to be assured by saturation. Hydrogen circulation rates of at least 1000 scf/bl (about 180 $n.l.l^{-1}$) will normally provide sufficient hydrogen to compensate for the expected hydrogen consumption as well as to ensure a low rate of catalyst aging. An interbed quench is generally desirable to maintain temperature in the process. Cold $H_2$ is generally used as the quench, but a liquid quench, usually recycled product, may also be used.

After the pour point of the lube oil has been reduced to the desired value by selective conversion, the resulting lube oil base stock may be subjected to additional treatments such as additional hydrotreating, in order to remove color bodies and produce a lube oil product of the desired characteristics. Fractionation may be employed to remove light ends and to meet volatility specifications.

It is apparent that the highly advantageous results achieved with the present process in terms of high lube oil yield, high VI, low pour point and other product properties can be ascribed to high isomerization selectivity resulting from a particular combination of metal activity, zeolite ZSM-5 acidity, proximity of acid sites to metal sites and zeolite ZSM-5 crystal size. While not being bound by theory, it is believed that the present invention achieves improved selectivity by use of a catalyst prepared by a combination of careful acidity reduction and the addition of a finely dispersed noble metal to reduce excessive cracking and enhance its isomerization capability. Acidity reduction by severe steaming enables the use of small zeolite ZSM-5 crystals to improve isomerization selectivity. The improved ZSM-5 catalyst also has greater feed flexibility and shows better aging characteristics than the more constrained intermediate pore zeolites such as ZSM-23.

Products

The products from the process are high VI, low pour point lube oil base stocks which are obtained in excellent yield. Besides having excellent viscometric properties they are also highly stable, both oxidatively and thermally, as well as to ultraviolet light. VI values of at least about 90 and more typically in the range of about 100 to 150 are obtained, depending upon the particular waxy lube oil feedstock being converted. The preferred waxy lube oil feedstocks to the process result in products having VI values of at least 130, typically 130 to 140. These values are readily achievable with product yields of at least 30 weight percent, usually at least 50 weight percent, based on the original waxy lube oil feedstock, and products having pour points below 40° F., typically between about −60 and 20° F., preferably between −20 and +20° F.

EXAMPLES

The following non-limiting examples illustrate the invention. The examples include the preparation of catalysts, in accordance with the invention and for use as comparative examples, and use of the various catalysts to catalytically convert various hydrocarbon feed streams.

Example 1

Catalysts were prepared as follows:

Catalyst A

A low acidity, high dispersion Pt/ZSM-5/$Al_2O_3$ catalyst, Catalyst A, was prepared as follows: A physical mixture of 80 parts ZSM-5, having a silica-to-alumina ratio of 55, and 20 parts pseudobohemite alumina was mulled to form a uniform mixture. All components were blended based on parts by weight on a 100% solids basis. About 2 wt % $HNO_3$ binding reagent was added to the mixture to improve the extrusion. A sufficient amount of deionized (DI) water was also added to form an extrudable paste. The mixture was auger extruded to 1/16" cylindrical shape extrudates and dried at 250° F. The extrudates were then nitrogen calcined at 900° F. for 3 hours followed by air calcination at 1000° F. for 6 hours, and steaming at 1450° F. for 12 hours. The steamed catalyst had an alpha activity of 1. The steamed extrudates were then exchanged with platinum using a 0.0064 M platinum tetraammine(II) chloride solution (5 cc/g). During the exchange, the pH was adjusted to ~5 using concentrated $NH_4OH$ solution. The extrudates were washed with DI water, dried in an oven at 250° F. and air calcined for 3 hours at 680° F. The finished platinum ZSM-5/$Al_2O_3$ catalyst had 0.44 wt % Pt. The dispersion of Pt particles in the catalyst was measured using hydrogen chemisorption. The adsorbed H to Pt mole ratio (H/Pt) was determined to be 0.92. This relatively high ratio of H/Pt indicates that Pt particles are dispersed throughout the extrudates as clusters made of a few Pt atoms. The properties of the final Catalyst A are listed in Table 1 below.

Catalyst B

A second low acidity, high dispersion Pt/ZSM-5/$Al_2O_3$ catalyst, Catalyst B was prepared as follows: A physical mixture of 65 parts ZSM-5, having a silica-to-alumina ratio of 55, and 35 parts pseudobohemite alumina was mulled to form a uniform mixture. All components were blended based on parts by weight on a 100% solids basis. About 2 wt % $HNO_3$ binding reagent was added to the mixture to improve the extrusion. A Sufficient amount of DI water was added to form an extrudable paste. The mixture was auger extruded to 1/16" cylindrical shape extrudates and dried at 250° F. The extrudates were then nitrogen calcined at 900° F. for 3 hours followed by air calcination at 1000° F. for 6 hours, and steaming at 1025° F. for 72 hours. The steamed catalyst had an alpha activity of 8. The steamed extrudates were then exchanged with platinum using a 0.0127 M platinum tetraammine(II) chloride solution (5 cc/g). During the exchange, the pH was adjusted to 8 using concentrated $NH_4OH$ solution. The extrudates were washed with DI water, dried in an oven at 250° F., and air calcined for 3 hours at 660° F. The finished platinum ZSM-5/$Al_2O_3$ catalyst had 1.1 wt % Pt. The absorbed H to Pt mole ratio (H/Pt) was determined by hydrogen chemisorption to be 1.1. The properties of the final Catalyst B are listed in Table 1 below.

Catalyst C

An H-form Pt/ZSM-5 catalyst, Catalyst C, was prepared as follows: A physical mixture of 98 parts ZSM-5, with a silica-to-alumina ratio of 55, and 2 parts 50 wt % NaOH caustic solution was mulled to form a uniform mixture. A sufficient amount of DI water was added to form an extrudable paste. The mixture was auger extruded to 1/16" cylindrical shape extrudates and dried in an oven at 250° F. overnight. The extrudates were then nitrogen calcined at 900° F. for 3 hours followed by two ammonium exchanges with 1 M $NH_4NO_3$ solution (5 cc solution/g catalyst), air calcination at 1000° F. for 6 hours, and steaming at 825° F. for 3 hours to provide an H-form catalyst. The H-form catalyst had an alpha activity of 280. The extrudates were then exchanged with platinum using a 0.0024 M platinum tetraammine(II) chloride solution (7.7 cc/g). During the exchange, the pH was adjusted to ~5 using concentrated $NH_4OH$ solution. The extrudates were washed with DI water, dried in an oven at 250° F. and air calcined for 3 hours at 715° F. The finished platinum ZSM-5 catalyst had 0.47 wt % Pt and a platinum dispersion measurement by chemisorption gave a H/Pt ratio of 1.4. The properties of the final Catalyst C are listed in Table 1.

Catalyst D

A low acidity Pt/ZSM-5/$SiO_2$ catalyst, Catalyst D, was prepared as follows: A physical mixture of 65 parts ZSM-5, having a silica-to-alumina ratio of 55, 17.5 parts amorphous silica and 17.5 parts colloidal silica was mulled to form a uniform mixture. All components were blended based on parts by weight on a 100% solids basis. About 3 wt % NaOH binding reagent was added to the mixture to improve the extrusion. A sufficient amount of DI water was added to form an extrudable paste. The mixture was auger extruded to 1/16" cylindrical shape extrudates and dried on a belt filter. The extrudates were then ammonium exchanged with 1 M $NH_4NO_3$ solution followed by nitrogen calcination at 900° F. for 3 hours, air calcination at 1000° F. for 6 hours and steamed at 1025° F. for 48 hours. The steamed catalyst has an alpha activity of 7. The steamed extrudates were then impregnated with platinum using platinum tetraammine(II) chloride solution. The extrudates were then air calcined for 3 hours at 660° F. The finished platinum ZSM-5/$SiO_2$ catalyst had 1.0 wt % Pt. Dispersion of Pt by hydrogen chemisorption gave a H/Pt ratio of 0.17. The properties of the final Catalyst D are listed in Table 1 below.

Catalyst E

A Pt/ZSM-23/$Al_2O_3$ catalyst, Catalyst E, was prepared as follows: A physical mixture of 65 parts ZSM-23, having a silica-to-alumina ratio of 130, and 35 parts pseudobohemite alumina was mulled to form a uniform mixture. All components were blended based on parts by weight on a 100% solids basis. A sufficient amount of DI water was added to form an extrudable paste. The mixture was auger extruded to 1/16" cylindrical shape extrudates and dried on a belt filter. The extrudates were then nitrogen calcined at 1000° F. for 3 hours followed by ammonium exchange with a 1 M $HN_4NO_3$ solution, air calcination at 1000° F. for 6 hours and steamed at 900° F. for 4 hours. The extrudates were exchanged with platinum using a 0.0024 M platinum tetraammine (II) chloride solution (7.7 cc/g). The extrudates were washed with DI water, dried in an oven at 250° F., and air calcined for 3 hours at 700° F. The finished platinum ZSM-23/$Al_2O_3$ catalyst had 0.25 wt % Pt and a platinum dispersion measurement by chemisorption gave a H/Pt ratio of 0.9. The properties of the final catalyst E are listed in Table 1 below.

TABLE 1

Physical and Chemical Properties of Dewaxing Catalysts

| Catalyst | A | B | C | D | E |
|---|---|---|---|---|---|
| Description | P/ZSM-5/ $Al_2O_3$ | Pt/ZSM-5/ $Al_2O_3$ | H-form-pt/ZSM-5 | Pt/ZSM-5/ $SiO_2$ | Pt/ZSM-23/$Al_2O_3$ |
| Alpha before Pt addition | 1 | 8 | 280 | 7 | 31 |
| Platinum, wt % | 0.44 | 1.1 | 0.47 | 1.0 | 0.25 |
| Pt Dispersion by Chemisorption (H/Pt) | 0.92 | 1.1 | 1.4 | 0.17 | 0.9 |
| Sodium, ppm | 120 | 40 | 50 | 600 | 60 |
| Surface Area, $m^2/g$ | 288 | 290 | 375 | 290 | 244 |

Example 2

Commercial grade normal hexadecane purchased from Aldrich was used to evaluate the effectiveness of reduced acidity and metals loading (i.e. metal dispersion) on the hydroisomerization activity and selectivity of ZSM-5 as follows: A 5.7 gram (10 $cm^3$)sample of Catalyst A was loaded into a ½ inch diameter fixed-bed micro unit reactor and 80/120 mesh sand was added to fill the void spaces. The catalyst was presulfided with 2% $H_2S$ in $H_2$ at 700° F. for 2 hrs. Then the reactor was cooled to 535° F. and the n-hexadecane feed was introduced. The pressure was maintained a 1000 psig, the LHSV was 0.4 $hr^{-1}$, and the temperature was adjusted to vary the hexadecane conversion. The experiment was repeated for Catalysts B and C, except that with Catalyst C the LHSV was 3 $hr^{-1}$, due to its extremely high activity. The isomerization performance results are summarized in Table 2 and FIG. 1.

TABLE 2 n-Hexadecane Hydroisomerization Performance

| Catalyst | A | B | C |
|---|---|---|---|
| Temperature at 95% n-$C_{16}$ Conversion, ° F. | 603 | 554 | 446 |
| LHSV ($hr^{-1}$) | 0.4 | 0.4 | 3 |
| Max i-$C_{16}$ Yield, wt % | 42 | 30 | 3 |

A review of Table 2 and FIG. 1 reveals that the low acidity Pt/ZSM-5 catalysts (Catalysts A and B) have significantly higher selectivity toward isomerization than the high acidity Pt/ZSM-5 catalyst (Catalyst C). Although the high acidity Catalyst C had extremely high activity, i.e. 95% n-$C_{16}$ conversion at 446° F. at LHSV of 3 $hr^{-1}$, the i-$C_{16}$ selectivity was extremely poor, due to catalytic cracking of n-hexadecane to light products such as $C_3$–$C_7$ paraffins.

Moreover, a comparison of the results obtained by using Catalysts A and B reveals that as the ZSM-5 acidity was lowered by extensive steaming, the selectivity for isomerization to i-$C_{16}$ was further improved. These results indicate that by reducing the ZSM-5 acidity, the amount of cracking can be reduced and the selectivity for producing high viscosity lube oil base stocks by converting hydrotreated hydrocarbons can be increased.

Example 3

Catalysts B and D were used, respectively, in the fixed-bed reactor of Example 2 to convert a hydrocracked heavy neutral slack wax feedstock. Feedstock properties are listed in Table 3.

TABLE 3

Properties of Hydrocracked Slack Wax

| | |
|---|---|
| API Gravity | 37.1 |
| Nitrogen, ppm | 2 |
| Sulfur, ppm | 3 |
| Oil in Wax % | 46 |
| Simulated Distiliation (M1401-1), ° F. | |
| IBP | 265 |
| 5% Off | 545 |
| 10% | 717 |
| 50% | 889 |
| 90% | 995 |
| FBP | 1066 |

5.7 gram (10 $cm^3$) samples of Catalyst B and D were respectively loaded into the fixed-bed reactor. The catalysts were presulfided with 2% $H_2S$ in $H_2$ at 400 psi to a maximum temperature of 700° F. The reactor was operated at a space velocity of 1 $hr^{-1}$, a $H_2$ partial pressure of 2000 psig, and a hydrogen circulation rate of about 4000 scf/bbl. The reaction temperature was varied to effect changes in conversion. The reaction products were distilled to a nominal 650° F. cut point and then solvent dewaxed. The solvent dewaxed oils were analyzed for pour point and viscosities at 40° C. and 100° C. The feedstock of Table 3 was also distilled and solvent dewaxed by the same procedure as a basis to determine the feedstock lube oil yield.

Figure 2:
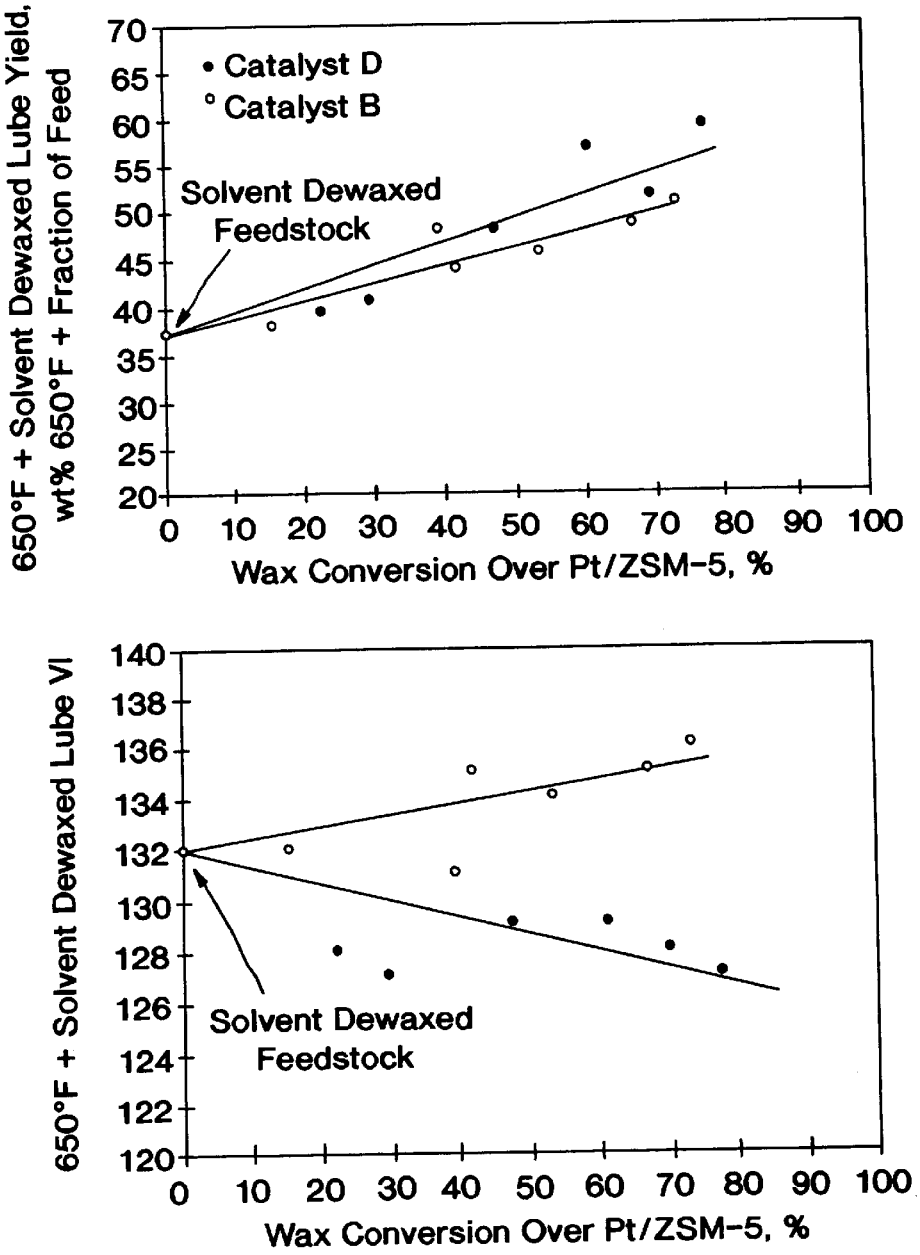
FIG. 2 illustrates the lube oil yield and viscosity index as a function of wax conversion for a hydrocracked slack wax using a 1 wt % Pt impregnated ZSM-5 catalyst and a 1 wt % Pt exchanged ZSM-5 catalyst.

The yield and VI results for each of these catalysts as a function of wax conversion are plotted in FIG. 2. A review of FIG. 2 reveals that both catalysts (Catalysts B and D) demonstrated the ability to isomerize the waxy lube feedstock. With increasing catalytic wax conversion up to around 80%, yield of solvent dewaxed oil increased because of wax conversion by isomerization. Feedstock lube yield after solvent dewaxing was 37% (on a 650° F.+ basis). Both Catalysts A and B increased the lube oil yield significantly to over 50%. For comparison, the same feedstock processed over a commercial NiW/F—$Al_2O_3$ wax isomerization catalyst gave a maximum solvent dewaxed lube yield of 40–45%.

Catalyst B, which was platinum-exchanged, showed an advantage in lube VI over Catalyst D, which was platinum-impregnated (FIG. 2, bottom plot). VI increased with increasing wax conversion over the Pt-exchanged catalyst (Catalyst B) but decreased by about 4–5 numbers over the impregated catalyst (Catalyst D).

Figure 3:
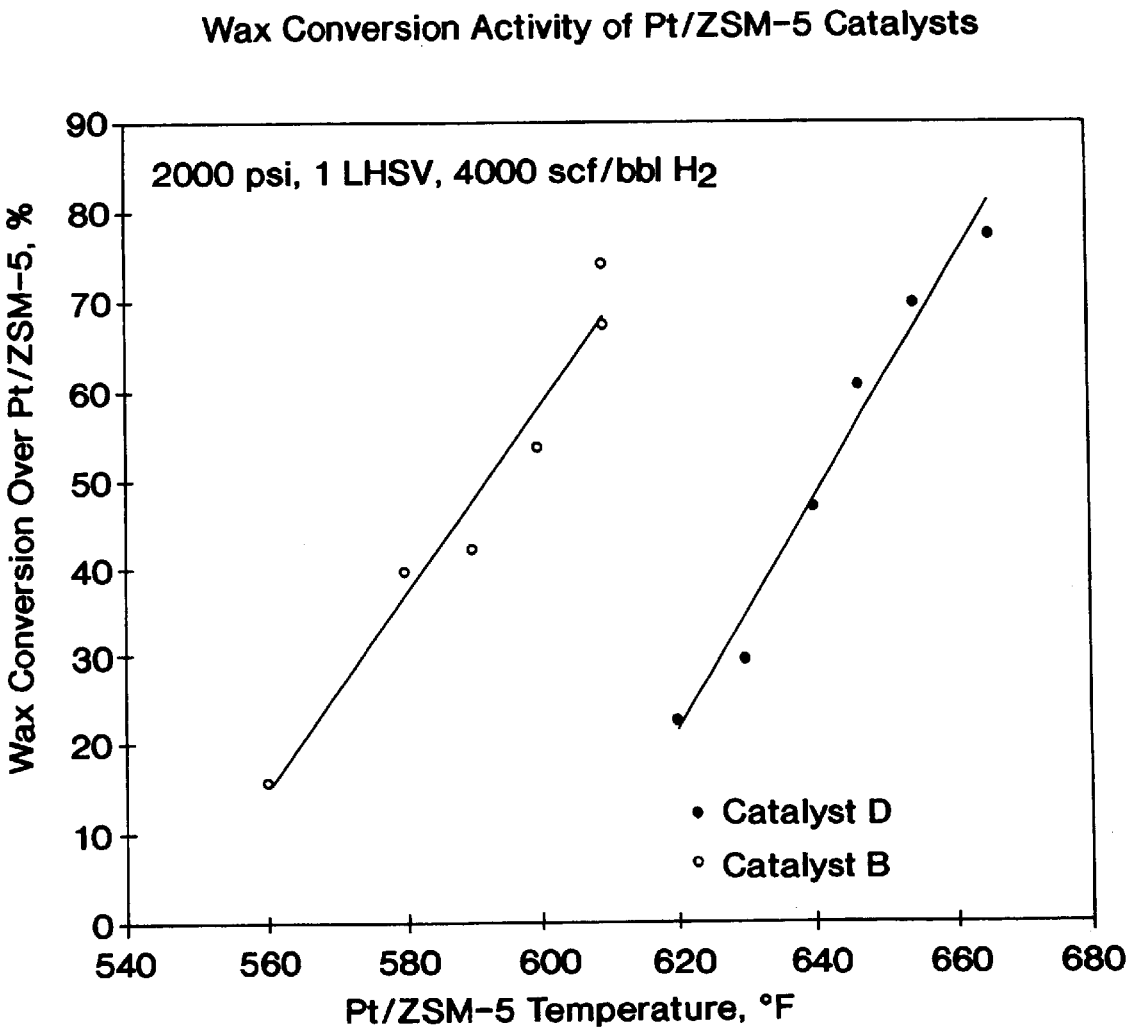
FIG. 3 shows the difference of wax conversion activity between a 1 wt % Pt impregnated ZSM-5 catalyst and a 1 wt % Pt exchanged ZSM-5 catalyst.

The activity of both catalysts (Catalysts B and D) were also evaluated by measuring the wax conversion as a function of temperature. The results are plotted in FIG. 3. A review of FIG. 3 reveals that Catalyst B showed an advantage in activity over Catalyst D. While not being bound by theory, it is believed that the activity increase was due to better dispersion and average proximity to acid sites. Chemisorption measurements indicate better dispersion for Catalyst B relative to Catalyst D (H/Pt of 1.1 vs. 0.17). These results suggest that selectivity of a Pt/ZSM-5 catalyst can only be improved by a combination of acidity reduction and finely dispersed Pt addition. Just lowering acidity alone would not produce all the desired catalyst performance.

Example 4

Catalyst B was used in the fixed-bed reactor of Example 2 to convert a hydrocracked heavy distillate feedstock. The feedstock properties are listed in Table 4.

TABLE 4

| Properties of Hydrocracked Distillate Feed | |
|---|---|
| Feed Description | 500N HVI |
| API Gravity | 30.3 |
| Pour Point, F | 120 |
| Flash Point, F | 491 |
| KV @ 100 C, cSt | 9.899 |
| Sulfur, ppm | <20 |
| Nitrogen, ppm | 2 |
| Oil in Wax (D3235), % | 77.9 |
| Sim Dist. (M1401) ° F. | |
| IBP | 695 |
| 5% Off | 724 |
| 10% | 750 |
| 50% | 905 |
| 90% | 1048 |
| FBP | — |

A 40 $cm^3$ gram sample of Catalyst B was loaded into the fixed-bed reactor. The catalyst was presulfided with 2% $H_2S$ in $H_2$ at 400 psi to a maximum temperature of 700° F. The reactor was operated at a LHSV of 1 $hr^{-1}$, an $H_2$ partial pressure of 2000 psig, and a hydrogen circulation rate of about 4000 scf/bbl. The reaction temperature was varied to effect changes in conversion and, as a result, changes in lube oil pour point. The reaction products were distilled to a nominal 650° F. cut point and analyzed for pour point and viscosities. The feedstock was also distilled and solvent dewaxed and analyzed for pour point and viscosity index as a comparison to the catalytic conversion process using Catalyst B.

Figure 4:
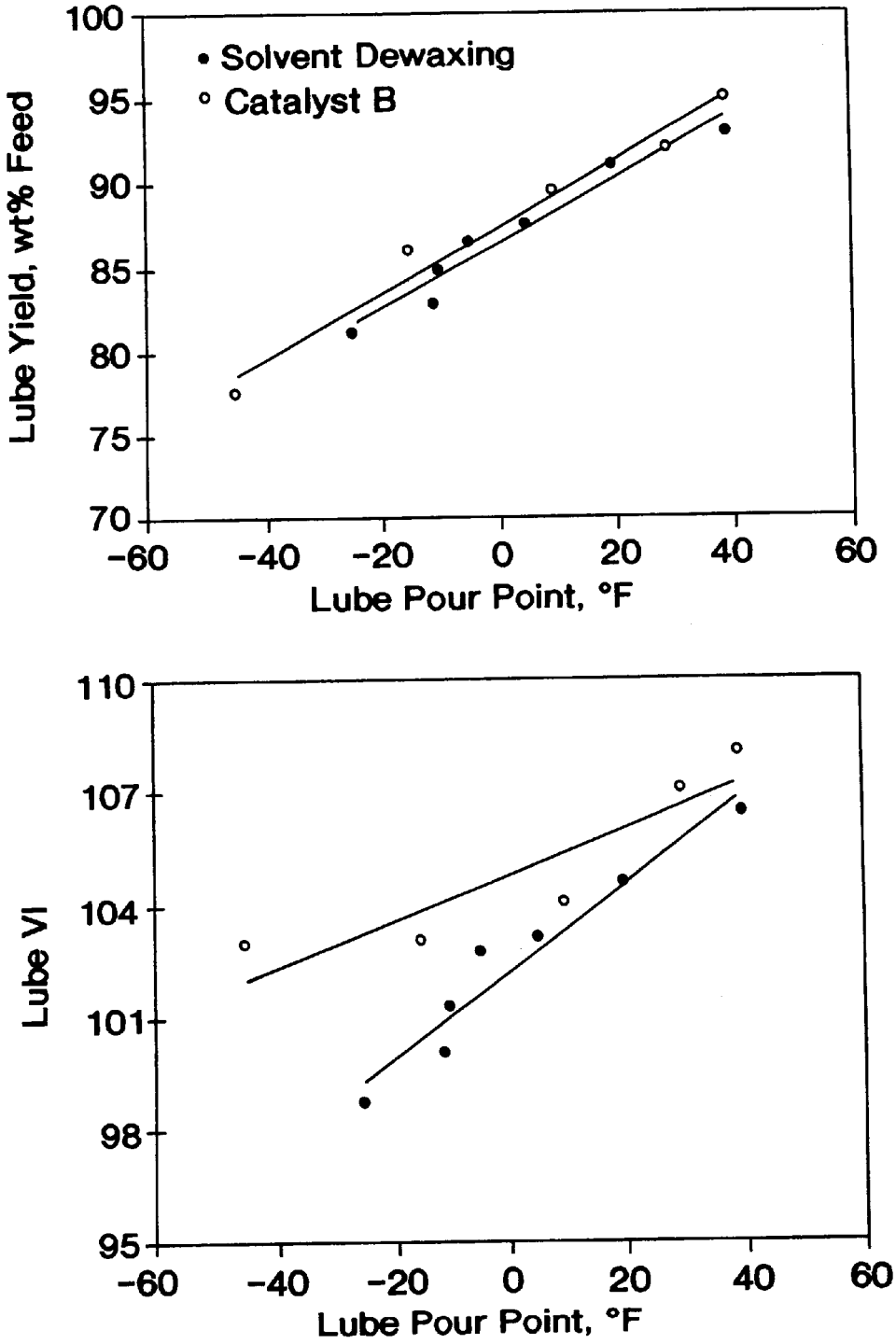
FIG. 4 shows a comparison of catalytic dewaxing, using a ZSM-5 catalyst according to the present invention, to solvent dewaxing for a hydrocracked heavy neutral feedstock.

A comparison of a conversion process using Catalyst B to solvent dewaxing is shown by FIG. 4. Catalyst B produced base stocks having a 2 VI number benefit over solvent dewaxing at typical commercial pour points and in approximately the same yield as for solvent dewaxing. Although not shown in FIG. 4, a commercial lube oil dewaxing ZSM-5 catalyst data on a similar feed showed a 4–5 VI number and 4–5% yield debit against solvent dewaxing. Very low pour point (−45° F.) was achieved at high yield (78%) with the low acidity, high metal dispersion Catalyst B.

Example 5

Example 4 was repeated, using a light neutral furfural raffinate feedstock in the presence of $H_2$, but at different $H_2$ partial pressures. The feedstock properties are listed in Table 5.

TABLE 5

| Properties of Solvent Extracted Light Neutral Raffinate | |
|---|---|
| API Gravity | 34.5 |
| Nitrogen, ppm | 23 |
| Sulfur, ppm | 2600 |
| KV @ 100 C, cSt | 3.58 |
| Pour Point, F | 75 |
| Sim Dist. (M1401-1), ° F. | |
| IBP | 569 |
| 5% Off | 624 |
| 10% | 646 |

TABLE 5-continued

| Properties of Solvent Extracted Light Neutral Raffinate | |
|---|---|
| 50% | 756 |
| 90% | 846 |
| FBP | 919 |

The $H_2$ partial pressure was maintain at both 400 and 2000 psi. The reaction products were distilled to a nominal 600° F. cut point and analyzed for pour point and viscosity index. The results are plotted in FIG. 5.

Figure 5:
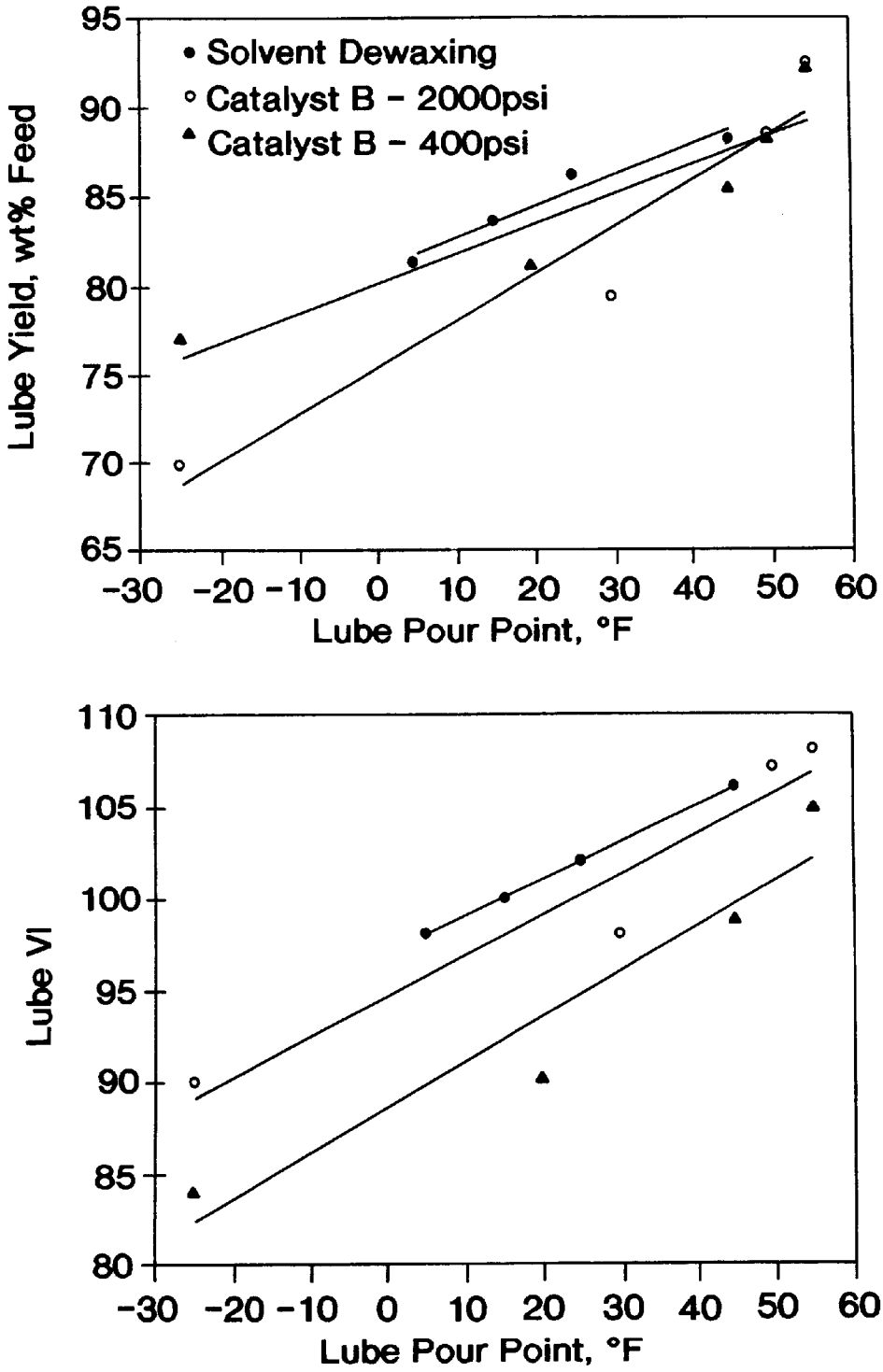
FIG. 5 shows a comparison of catalytic dewaxing, using a ZSM-5 catalyst according to the present invention, to solvent dewaxing for a light neutral furfural raffinate feedstock.

A review of FIG. 5 reveals that at high pressure, lube VI approaching that of solvent dewaxing can be obtained at a yield debit of about 5% versus solvent dewaxing. Low pressure operation results in lube yield equivalent to solvent dewaxing with a 9 number VI debit. It is clear that optimization of the Pt/ZSM-5 operating pressure would lead to significantly improved performance over highly shape selective standard lube oil dewaxing catalysts which gives a 7–10% yield debit and produce base stocks with 7–10 lower VI values than solvent dewaxing for this feed independent of operating pressure.

Accordingly, the Pt/ZSM-5 catalyst of the present invention is able to tolerate a wider variety of feedstocks than are highly shape selective, unidimensional pore dewaxing catalysts such as ZSM-23. The intersecting channels of ZSM-5 are less susceptible to pore blockage and its larger pore opening permits easier access to wax species. Highly shape selective dewaxing catalysts can typically be used only for severely hydroprocessed feeds.

Example 6

Catalyst B and Catalyst E were each used respectively to convert a heavy neutral hydrocrackate feedstock. The feedstock properties are listed in Table 6.

TABLE 6

| Properties of Heavy Neutral Hydrocrackate | |
|---|---|
| API Gravity | 29.3 |
| Sulfur, ppm | 24 |
| Nitrogen, ppm | <0.5 |
| Hydrogen, % | 13.38 |
| KV @ 100 C, cSt | 9.6 |
| Wax Content at 10 F Pour, % | 17 |
| Aromatics Content, % | 15 |
| Sim Dist. (M1567), ° F. | |
| IBP | 686 |
| 5% Off | 704 |
| 10% | 753 |
| 50% | 927 |
| 90% | 1038 |
| FBP | 1138 |

The catalysts were presulfided with 2% $H_2S$ in $H_2$ at 400 psi to a maximum temperature of 700° F. The experiments were conducted at a space velocity of 1 $hr^{-1}$, a $H_2$ partial pressure of 2000 psig, and a hydrogen circulation rate of about 4000 scf/bbl.

The feedstock was converted to a target pour point of 10° F. over each catalyst for a period of 30 days. The reaction temperature was adjusted to maintain the target pour point. Over the course of the 30 day period, the temperature for Catalyst E had to be increased by 75° F. to maintain a 10° F. pour point, while Catalyst B aged by less than 10° F. over the same time period. Thus, even for severely hydroprocessed feedstocks, a low-acidity, high metal dispersion Pt/ZSM-5 can offer a significant advantage in aging rate over a highly shape selective Pt/ZSM-23 dewaxing catalyst.

We claim:

1. A process for increasing the viscosity index of a dewaxed lube oil base stock resulting from a hydrotreated hydrocarbon lube oil feedstock containing waxy paraffins which comprises contacting a hydrotreated hydrocarbon lube oil feedstock containing waxy paraffins with a catalyst comprising ZSM-5, which has been subjected to a controlled acidity reduction to an alpha value less than about 15 prior to metals addition, and which catalyst further comprises from 0.1 to 5 wt %, based on catalyst, of a finely dispersed noble metal component, said noble metal having a ratio of H to noble metal as measured by chemisorption of at least about 0.6 and a ratio of O to noble metal of at least about 0.4, in the presence of hydrogen, under conversion conditions.

2. The process of claim 1 wherein said hydrotreated hydrocarbon lube oil feedstock is selected from the group consisting of a hydrotreated slack wax, distillate, light neutral distillate, heavy neutral distillate, furfural raffinate, Fischer-Tropsch wax, bright stock, deasphalted oils and mixtures or blends thereof.

3. The process of claim 1 wherein said lube oil base stock has a pour point which ranges from about −60 to about +20° F., a Viscosity Index of at least about 90 and a lube oil base stock yield of at least about 30%.

4. The process of claim 1 wherein said controlled acidity reduction comprises high temperature steaming at conditions comprising a temperature of above 550° C. to about 900° C., pressures of about atmospheric to about 100 psig, for a time of at least about 12 hours to about 96 hours, and an atmosphere of from about 50% to about 100% water vapor.

5. The process of claim 1, in which said catalyst has an alpha value of less than about 15 prior to incorporation of the noble metal component.

6. The process of claim 1, in which said catalyst has an alpha value of less than about 5 prior to incorporation of the noble metal component.

7. The process of claim 1, in which the noble metal of the noble metal component is Pt, Pd or mixtures of Pt and Pd.

8. The process of claim 1, in which the finely dispersed noble metal component is incorporated into said catalyst by ion exchange.

9. The process of claim 1, wherein said conversion conditions include a hydrogen partial pressure ranging from 300 to 3500 psig and a temperature from about 200 to 400° C.

* * * * *